US005481076A

United States Patent [19]

Mullet et al.

[11] Patent Number: 5,481,076

[45] **Date of Patent: * Jan. 2, 1996**

[54] ASTRAGAL FOR CLOSURE MEMBERS

[75] Inventors: Willis Mullet, Pensacola Beach; Albert W. Mitchell; Joseph D. Hudson, both of Pace; Eric J. Wiborg, II, Cooper City, all of Fla.

[73] Assignee: Wayne-Dalton Corp., Mt. Hope, Ohio

[ * ] Notice: The portion of the term of this patent subsequent to Nov. 9, 2010, has been disclaimed.

[21] Appl. No.: 50,013

[22] PCT Filed: Apr. 16, 1993

[86] PCT No.: PCT/US93/03604

§ 371 Date: Mar. 30, 1994

§ 102(e) Date: Mar. 30, 1994

[87] PCT Pub. No.: WO93/21414

PCT Pub. Date: Oct. 28, 1993

Related U.S. Application Data

[63] Continuation-in-part of Ser. No. 870,299, Apr. 17, 1992, Pat. No. 5,259,143.

[51] Int. Cl.[6] ..... H01H 3/16

[52] U.S. Cl. ..... 200/61.43; 49/27

[58] Field of Search ..... 200/61.43, 275; 49/25–27, 26–29, 497

[56] References Cited

U.S. PATENT DOCUMENTS

| | | | |
|---|---|---|---|
| 2,796,484 | 6/1957 | Wolf | 200/61.57 |
| 2,843,690 | 7/1958 | Miller | 200/61.43 |
| 2,952,751 | 9/1960 | Cookson, Jr. et al. | 200/61.43 |
| 3,118,984 | 1/1964 | Koenig | 200/61.43 |
| 3,133,167 | 5/1964 | Miller | 200/61.43 |
| 3,243,540 | 3/1966 | Miller | 200/86 |
| 3,260,812 | 7/1966 | Miller | 200/61.43 |
| 3,303,303 | 2/1967 | Miller | 200/61.43 |
| 3,315,050 | 4/1967 | Miller | 200/61.43 |
| 3,321,592 | 5/1967 | Miller | 200/61.43 |
| 3,462,885 | 8/1969 | Miller | 49/488 |
| 3,509,360 | 4/1970 | Miller | 307/119 |
| 3,693,026 | 9/1972 | Miller | 307/119 |
| 3,754,176 | 8/1973 | Miller | 318/266 |
| 3,830,018 | 8/1974 | Arai et al. | 49/28 |
| 3,855,733 | 12/1974 | Miller | 49/488 |

(List continued on next page.)

FOREIGN PATENT DOCUMENTS

| | | | |
|---|---|---|---|
| 0381578 | 8/1990 | European Pat. Off. | E05F 15/00 |
| 0489610A1 | 6/1992 | European Pat. Off. | E05F 15/00 |
| 1077435 | 11/1954 | France | E06B 1/23 |
| 1549640 | 12/1968 | France | E05F 15/00 |
| 2643505 | 3/1978 | Germany | H01H 13/12 |
| 3427939 | 9/1985 | Germany | E06B 7/21 |
| 8608064 | 6/1986 | Germany | E05F 15/20 |
| 9306503 U | 8/1993 | Germany | E05F 15/20 |

*Primary Examiner*—J. R. Scott

*Attorney, Agent, or Firm*—Renner, Kenner, Greive, Bobak, Taylor & Weber

[57] ABSTRACT

An astragal (10; 310; 410; 510) for attachment between a movable closure member (11; 111; 311; 411; 611) and a fixed surface having a sealing device and having an electrical switching device to signal engagement with an object including a retainer (15; 115; 315; 415; 615) secured to one of the closure member and the fixed surface, an elongate arcuate sealing member (30; 330; 430; 530; 630; 730; 830; 930) for engaging the other of the closure member and the fixed surface when in close proximity, the arcuate sealing member selectively affixed to the retainer, a resilient carrier (45; 345; 445; 545; 645; 745; 850; 950) disposed within the arcuate sealing member, and at least one electrically conductive strip (46; 346; 447; 547; 651; 746; 846; 946) attached to the carrier in unobstructed facing relation to an electrically conductive contact (20; 120; 320; 448; 548; 620) and temporarily movable into engagement with the electrically conductive contact when an object displaces the arcuate sealing member and the resilient carrier to effect electrical contact therebetween.

15 Claims, 5 Drawing Sheets

U.S. PATENT DOCUMENTS

| | | | |
|---|---|---|---|
| 3,896,590 | 7/1975 | Miller | 49/488 |
| 3,952,455 | 4/1976 | McAlarney | 49/497 |
| 4,051,336 | 9/1977 | Miller | 200/61.43 |
| 4,115,952 | 9/1978 | French | 49/26 |
| 4,137,116 | 1/1979 | Miller | 156/269 |
| 4,273,974 | 6/1981 | Miller | 200/61.43 |
| 4,365,188 | 12/1982 | Walter | 318/282 |
| 4,532,388 | 7/1985 | Sackmann et al. | 200/61.43 |
| 4,600,819 | 7/1986 | Twyford | 200/16 A |
| 4,648,768 | 8/1987 | Sackmann et al. | 200/61.43 |
| 5,079,417 | 1/1992 | Strand | 250/221 |
| 5,168,138 | 12/1992 | Evans | 200/61.52 |
| 5,259,143 | 11/1993 | Mitchell et al. | 49/27 |
| 5,260,529 | 11/1993 | Miller | 200/61.43 |
| 5,296,658 | 3/1994 | Kramer et al. | 200/61.43 |

FIG. 4
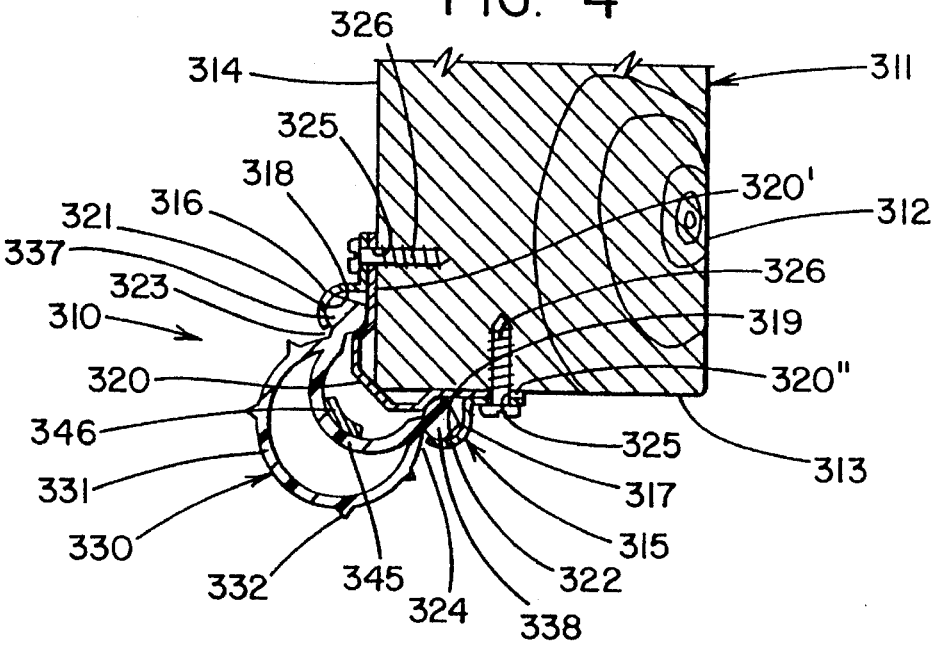
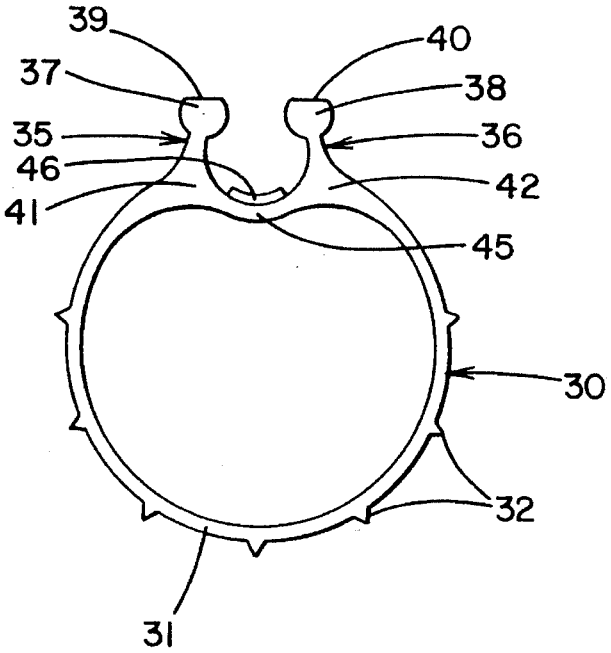
FIG. 3
FIG. 5
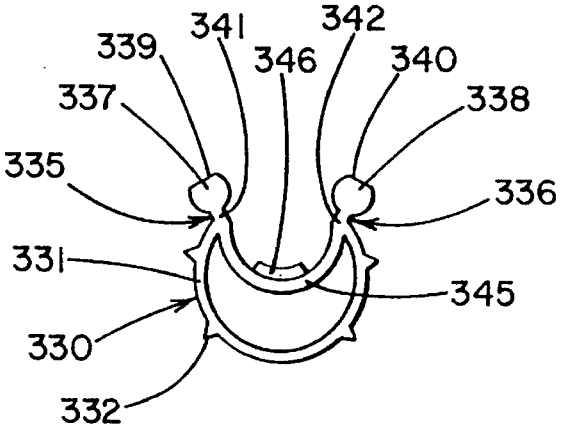

ASTRAGAL FOR CLOSURE MEMBERS

CROSS-REFERENCE TO RELATED APPLICATION

This application is a continuation-in-part of U.S. Ser. No. 07/870,299, filed Apr. 17, 1992, now U.S. Pat. No. 5,259,143.

TECHNICAL FIELD

Generally, the present invention relates to an astragel for use on a closure member movable relative to a fixed member. More particularly, the present invention relates to an astragel which has a sealing device for disposition on the closure member and incorporates an electrical switching device. More specifically the present invention relates to an astragel having a sealing device for engaging such a fixed member and having an electrical switching device to signal engagement of the astragel with a foreign object, together with circuitry to monitor the operational readiness of the astragel switching device, to detect the signal upon engaging an object and to control the drive system actuating the closure member.

BACKGROUND ART

For many years, astragals have been provided on various types of closure members which move into and out of proximity to a fixed or a movable surface for effecting sealing engagement therewith. Examples of the types of applications for such astragels include the doors of garages, commercial and utility buildings, and similar applications. A wide variety of materials and geometric configurations have been employed in the construction of such astragels.

Originally, most doors of this type were manually operated, with large-sized or extremely heavy doors being counter-balanced to permit operation for opening and closing by a single person. The necessary usage of mechanical assistance in the instance of very large doors for commercial installations and more recently commonly in regard to smaller garage doors for the sake of convenience has resulted in the wide usage of electric motors to power the opening and closing of such doors. Attendant the usage of powered doors, there has arisen the safety concern of a power-operated door closing with a person or other foreign object in the opening. This has become a particularly troublesome consideration with the widespread usage of remote controllers to actuate the closing and opening of such doors from a distance or from an obstructed vantage point where it is impossible to ascertain that the door opening is free of obstructions or will necessarily remain free of obstructions during closing.

Generally two approaches have been taken to implement the safety feature of stopping or reversing such doors when an obstruction in the opening is encountered by the door during closing. In some instances, the motor or drive train effecting the closing and opening of the door is adapted to sense substantially increased displacement opposition exceeding that normally encountered during the closing of the door. While affording an extent of safety protection, these types of devices are often highly sensitive to precise adjustment, require frequent readjustment, and are otherwise prone to operational malfunction.

The other type of safety device for such doors contemplates the placement of some type of mechanical actuator, electrical switch, or sensor on the leading edge of the door to engage any object which might be encountered during closing of the door and actuate suitable controls to stop and/or reverse the motor which drives the door during opening and closing. Edge-mounted actuating devices have taken many forms. In some instances, bars of various types have been mounted on linkages and connected to a switch. In other instances, a cable member has been stretched between the extremities of the door edge which is adapted to actuate a switch when the cable is sufficiently displaced. Another approach has been to employ tubing of plastic or rubber which is flexible and filled with a liquid or gaseous pressure which is adapted to activate a switch when pressurized.

Efforts have also been made to develop an astragal which performs conventional sealing functions while incorporating the characteristics of a safety switch in an edge-mounted device. Such astragals commonly employ a base which is mounted to the door edge and a movable member which is positioned in spaced relation to the base. The base and the movable member mount substantially rigid or, in some instances, somewhat flexible conductive elements which are positioned in spaced relation during normal operation of a door. While offering some advantages with respect to mechanical linkage devices, these astragals have been subject to various types of problems resulting from the particular construction features employed. For example, past astragal construction configurations have precluded or made exceedingly difficult cutting an astragal to length at any time after manufacture. Also, depending upon the materials which may be employed, in some instances it is possible for moisture or dirt to permeate or enter the interior of the astragal and thus affect either the operability or reliability of the electrical contacts. In other instances, the movable member of the astragal, in carrying out its sealing function, may be permanently deformed to an extent that the electrical contacts are in permanent engagement, thereby rendering the safety-edge feature and the door inoperative. To counter this problem, the movable member may be constructed of a foam material, or foam may be interposed between the movable member and base for purposes of maintaining appropriate spacing between the electrical contacts. Different geometric configurations of the base and movable members of the astragal have also been tried to accommodate varying distortions in the movable member caused by irregular surfaces at which a seal is to be made, while providing consistent operation of an incorporated switching device; however, a reliable, inexpensive astragal providing the requisite sealing and safety features which is adaptable to different door profiles and useable on vertically-moving and pivotal doors has not emerged in the marketplace.

DISCLOSURE OF THE INVENTION

Therefore, an object of the present invention is to provide an astragal which is a combined sealing device for disposition between a door which is movable into and out of proximity with a fixed surface which is to be sealed relative to the door and an electrical switching device to signal engagement with a foreign object in the door opening during closing thereof. Another object of the present invention is to provide such an astragal which can be mounted in various ways on a door, depending upon the characteristics of the leading edge of the door. A further object of the present invention is to provide such an astragal which in another embodiment of the invention is particularly adapted for positioning a door which pivots angularly into and out of proximity to a surface rather than moving perpendicular thereto. Still another object of the present invention is to provide such an astragal which may have utility in relation to doors having a plurality of top suspended, hinged vertical panels, windows of various configurations, or other types of closure members.

Another object of the present invention is to provide such an astragal which has an elongate, generally tubular or arcuate sealing member for engaging a surface to be sealed relative to the door when in proximity thereto. A further object of the present invention is to provide such an astragal having a tubular or arcuate sealing member which is adaptable for sealing engagement with an irregular surface without introducing distortion which alters the designed spacing between the conductive strips when not in engagement with a foreign object. Yet another object of the present invention is to provide such an astragal having an elongate sealing member which has a plurality of circumferentially-spaced, longitudinally-extending nubs for engagement with the surface to be sealed relative to the door.

Another object of the present invention is to provide an astragal having a fixed retainer operating as one electrical contact and a facing conductive strip which is movable into contact with the retainer when an object distorts a resilient carrier on which the conductive strip is mounted. A further object of the present invention is to provide such an astragal wherein the resilient carrier for the conductive strip is sized and configured such that the conductive strip engages the retainer with sufficient surface area such as to make effective electrical contact therewith, substantially irrespective of the angle at which a foreign object in a door opening may encounter and distort the resilient carrier. Yet another object of an embodiment of the invention is to mount a pair of conductive strips in opposed, normally spaced relationship in a resilient carrier. Still a further object of the invention is to provide an astragal whose configuration facilitates post-manufacture cutting of the same to any selected length without interference to the electrical contact or conductive strip.

Still another object of the present invention is to provide an astragal having a generally tubular or arcuate sealing element which is readily slidably received and positioned in a retainer, such that a defective or damaged sealing member may be readily replaced, or, if necessary, the retainer may be removed from the door. Yet a further object of the present invention is to provide such an astragal wherein the tubular sealing member, the resilient carrier, and the conductive strip for the resilient carrier can be simultaneously extruded as an integral, one-piece unit. Still another object of the present invention is to provide astragal sealing members which are sufficiently flexible to permit rolling or folding to facilitate shipping, storage, and display as a compact package. Yet a further object of the present invention is to provide an astragal which is highly durable, which can be produced relatively inexpensively, and which may be readily adapted for both new and replacement installation on a wide variety of door configurations.

In general, the present invention contemplates an astragal for attachment between a movable closure member and a fixed surface having a sealing device and having an electrical switching device to signal engagement with an object including a retainer secured to one of the closure member and the fixed surface, an elongate arcuate sealing member for engaging the other of the closure member and the fixed surface when in close proximity, the arcuate sealing member selectively affixed to the retainer, a resilient carrier disposed within the arcuate sealing member, and at least one electrically conductive strip attached to the carrier in unobstructed facing relation to an electrically conductive contact and temporarily movable into engagement with the electrically conductive contact when an object displaces said arcuate sealing member and the resilient carrier to effect electrical contact therebetween.

The present invention further contemplates an electrical switching device to signal engagement of a closure member movable in and out of proximity to a surface with an object including an electrically conductive contact in part secured to one of the closure member and the surface and having a first resistance, and an electrically conductive strip in part secured to the one of the closure member and the surface not in part secured to the contact and having a second resistance. An end of the contact and an end of the strip are in electrical engagement. Two conductors each electrically engage at least one of the contact and the strip other than at said end of the contact and the end of the strip in electrical engagement and other than at the point of engagement of the other. A power supply is electrically connected to the two conductors for establishing a signal through the contact and the strip, and a sensor monitors a characteristic of the signal and generates an alarm signal in the event the closure member engages the object.

BRIEF DESCRIPTION OF THE DRAWINGS

FIG. 3 is an enlarged elevational view of the tubular sealing element, the resilient carrier, and the electrically conductive strip element of the astragal depicted in FIGS. 1 and 2.

FIG. 4 is a cross-sectional view of an exemplary astragal showing a second embodiment of the concepts of the present invention, the view depicting the astragal mounted on the lower corner of a pivotally closing door.

FIG. 5 is an enlarged elevational view of the tubular sealing element, the resilient carrier, and the electrically conductive strip element of the astragal depicted in FIG. 4.

PREFERRED EMBODIMENT FOR CARRYING OUT THE INVENTION

Figure 1:
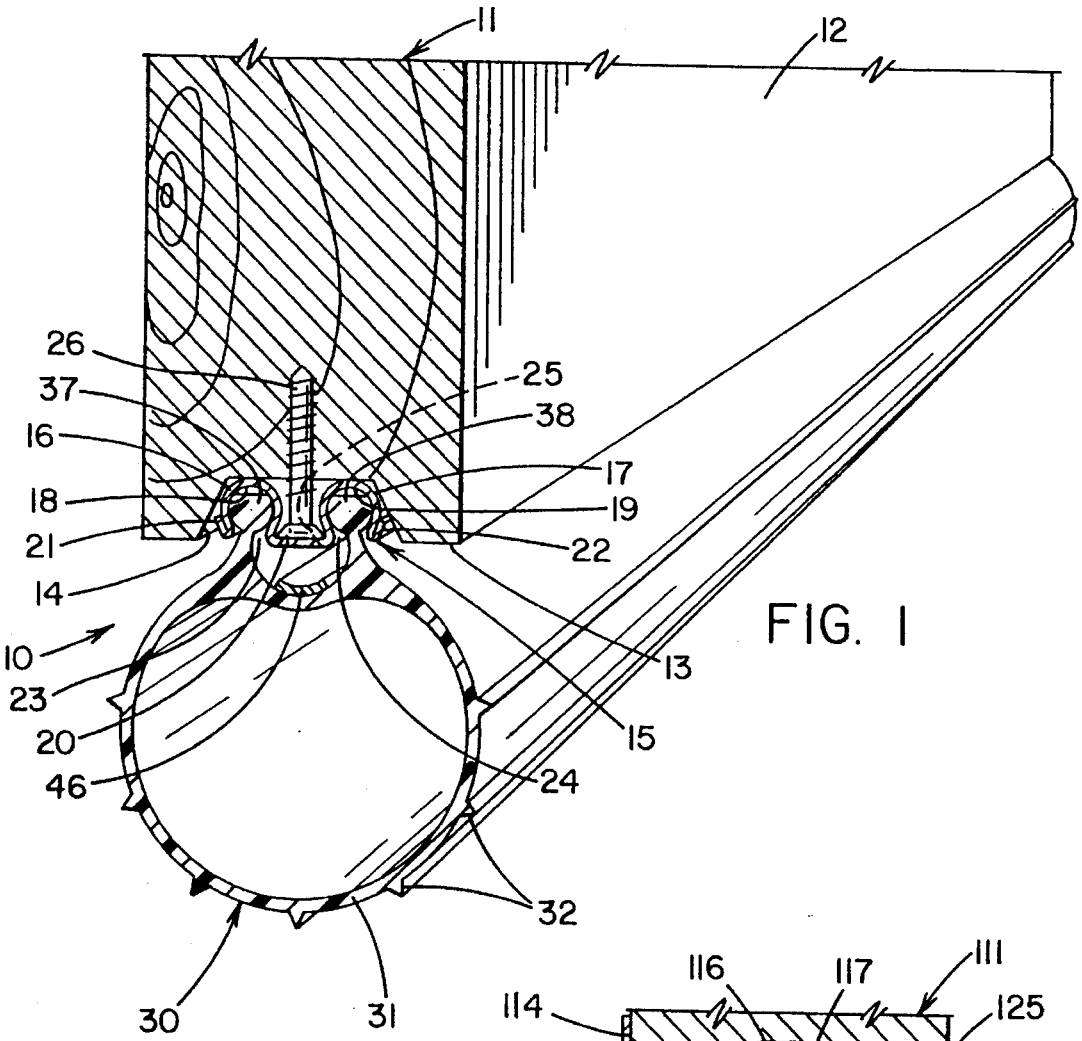
FIG. 1 is a perspective view extending from a vertical section through a vertically moving door and an exemplary astragal embodying the concepts of the present invention showing the attachment to the door by fasteners extending through the retainer element of the astragal.
Figure 2:
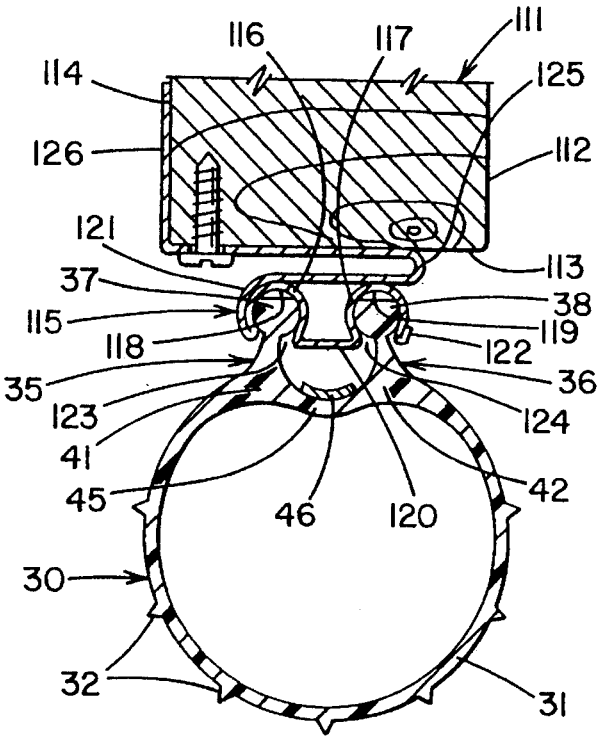
FIG. 2 is a cross-sectional view showing a modified form of retainer element for attachment of the astragal to a door having a different profile.

An astragal according to the concepts of the present invention, and particularly the first embodiment thereof depicted in FIGS. 1–3 of the drawings, is generally indicated by the numeral 10. The astragal 10 may be employed in conjunction with a wide variety of doors of the type employed in garages, commercial and utility buildings, and other structures, as well as windows or other closure members, all of which may be linear, curved, or otherwise non-linear in whole or in part. Such doors or other members are commonly constructed of a variety of materials such as wood, metal, various plastics, or combinations thereof. The lower extremity of doors or other members of these various types may be substantially rectangular or may be profiled in any number of ways for the positioning of reinforcing members, the attachment of an astragal, or for other purposes.

In the exemplary embodiment of the invention depicted in FIG. 1 of the drawings, there is shown a segment of a door, generally indicated by the numeral 11. The door 11, as shown for exemplary purposes, has a generally rectangular cross section which includes an outer face 12 and a bottom 13. In this instance, the door 11 could be a typical sectional door wherein the sections are hinged together, and the portion shown in FIG. 1 is the lowermost section. As shown, the door bottom 13 has a trapezoidal cutout 14, which is adapted to receive the astragal 10. It is to be appreciated that the cutout 14 may take rectangular or other geometric configurations and may be otherwise positioned relative to the lateral dimension of the door bottom 13.

As shown in FIG. 1 of the drawings, the trapezoidal cutout 14 is adapted to receive a retainer, generally indicated by the numeral 15. The retainer 15 is preferably cooperatively sized with respect to the lateral dimension of the trapezoidal cutout 14 such that retainer 15 would be effectively partially supported and reinforced by the door 11.

The retainer 15 has a pair of spaced receivers 16 and 17, which inwardly thereof form a pair of substantially parallel spaced grooves 18 and 19, respectively. As shown, the grooves 18, 19 are substantially cylindrical; however, it will be appreciated that oblong circular configurations, triangles, or other geometric configurations could be successfully employed. The receivers 16, 17 of the retainer 15 are spaced and joined by a contact section 20, which may advantageously be positioned substantially tangential to the grooves 18 and 19 formed by the receivers 16 and 17. The extremity of the receivers 16 and 17 may have return flanges 21 and 22 which may be incorporated for reinforcement purposes. The contact section 20 and the return flanges 21 and 22 are spaced a distance to form openings 23 and 24 for the purpose to be described hereinafter.

The retainer 15 may advantageously be formed of an electrically conductive material throughout, such as a galvanized steel. In this manner, the contact section 20 is electrically conductive, and sufficient strength may be readily imparted to retainer 15 to withstand the use and abuse to which doors of this type are commonly subjected. Alternatively, the retainer 15 could be of other metallic or plastic materials, with the contact section 20 being of a conductive material or at least coated on the outer surface opposite door 11 with a conductive coating.

For purposes of securing the retainer 15 to door 11, the contact section 20 may be provided with longitudinally-spaced bores 25 through which appropriate fasteners 26 may be inserted to extend into the door 11. It will be appreciated by persons skilled in the art that suitable fasteners may be selected depending upon the material from which door 11 is constructed.

The astragal 10 has a sealing member, generally indicated by the numeral 30 in FIGS. 1–3 of the drawings. As best seen in FIG. 1, the sealing member 30 has an elongate tubular body 31 which normally extends the width of the door 11 and which is of a generally circular cross section. The tubular body 31 may be provided with a plurality of radially outwardly projecting nubs 32 which, as seen in FIG. 1, extend longitudinally of tubular body 31, preferably the entire longitudinal extent thereof. The nubs 32 may be radially outwardly tapered to an apex for purposes of effecting essentially point contact with an apron, the ground, or other surface to which a seal is to be effected relative to the door 11 when it is in the closed position. To insure contact with irregular surfaces or in the event portions of the tubular body 31 are substantially deflected, a number of nubs 32 may be positioned circumferentially spaced about the lower portion of sealing member 30 in the mounted position on a door 11 depicted in FIG. 1 of the drawings. As shown for exemplary purposes, the nubs 32 are located at approximately 30-degree intervals circumferentially about the outer surface of tubular body 31.

Referring to FIG. 3, the tubular body 31 is outwardly discontinuous at a pair of circumferential ends, generally indicated by the numerals 35 and 36. The circumferential ends 35, 36 include enlarged projections 37 and 38, respectively. As can best be seen in FIG. 1, the projections 37 and 38 are spaced and positioned such as to interfit with the grooves 18 and 19, respectively, of the retainer 15 without significant deflection from the initial configuration depicted in FIG. 3 of the drawings. As shown, the projections 37, 38 are substantially cylindrical and sized to fit the grooves 18, 19. If desired, a portion of the projections 37, 38 may be removed to form flats 39 and 40. The flats 39, 40 are provided to facilitate the sliding ingress and egress of projections 37, 38 in the grooves 18, 19 when a sealing member 30 is inserted in retainer 15 from one end of the door 11 during installation of an astragal 10 or when it is necessary to replace a worn or damaged sealing member 30.

The circumferential ends 35, 36 of sealing member 30 have marginal lands 41 and 42 which, in part, interconnect the tubular body 31 with the enlarged projections 37, 38, respectively. The lands 41 and 42 are also interconnected by a carrier 45 which is of arcuate configuration. As shown, the carrier 45 and lands 41, 42 form substantially a segment of a circle centered approximately centrally of the contact section 20 of retainer 15 when the astragal 10 is in the assembled position depicted in FIG. 1 of the drawings. The radial inner surface of the carrier 45 mounts substantially medially thereof a conductive strip 46 which is in unobstructed facing relationship to the contact section 20 of the retainer 15 when the astragal 10 is in the mounted configuration depicted in FIG. 1 of the drawings. The conductive strip 46 is of a sufficient arcuate extent such that when the sealing member 30 engages an object so that the body portion 31 is deflected into the carrier 45, which is in turn displaced toward the contact section 20 of retainer 15, there will necessarily be a sufficient contact area as between conductive strip 46 and contact section 20 to provide the requisite indicia to operate as a switch for the control system for the door 11. As best seen in FIG. 1, the openings 23, 24 to the grooves 18, 19 are preferably somewhat wider than the proximate portions of the lands 41, 42 such that the enlarged projections 37, 38 may rotate to a limited extent in the grooves 18, 19 to permit the requisite displacement of the carrier 45 without undue deflection of the lands 41, 42 in the areas proximate to the projections 37, 38.

Exemplary materials which might be employed for constructing the sealing member 30 are foamable, extrudable, relatively flexible thermoplastics such as chlorinated polyethylene, ethylene propylene diamine, polyvinyl chloride, or alpha butyl styrene. The conductive strip 46 of sealing member 30 may be a dense conductive EPDM or dense conductive silicone elastomer, as discussed further hereinbelow. The judicious selection of these materials can make possible the simultaneous co-extrusion of the tubular body 31 and the conductive strip 46 such as to provide an integral sealing member 30. It will be appreciated, however, that the conductive strip 46 could be separately formed and positioned and affixed, as by an adhesive, to the carrier 45.

A modified form of retainer, generally indicated by the numeral 115, is shown in conjunction with a door 111 and the sealing member 30 in FIG. 2 of the drawings. The door 111, as shown for exemplary purposes, has a generally rectangular cross section which includes an outer face 112 and a bottom 113. In this instance, the door 111 is again a sectional door wherein the sections are hinged together, and the portion shown in FIG. 2 is the lowermost section. As shown, the door bottom 113 has a plain rectangular configuration.

As shown in FIG. 2 of the drawings, the door 111 is adapted to receive the retainer 115. The retainer 115 has a pair of spaced receivers 116 and 117, which inwardly thereof form a pair of substantially parallel spaced grooves 118 and 119, respectively. As shown, the grooves 118, 119 are substantially cylindrical; however, it will be appreciated that oblong circular configurations, triangles, or other geometric configurations could be successfully employed. The receivers 116, 117 of the retainer 115 are spaced and joined by a contact section 120, which may advantageously be positioned substantially tangential to the grooves 118 and 119 formed by the receivers 116 and 117. The extremity of the receivers 116 and 117 may have return flanges 121 and 122 which may be incorporated for reinforcement purposes. The contact section 120 and the return flanges 121 and 122 are spaced a distance to form openings 123 and 124 for the purpose to be described hereinafter.

The retainer 115 may advantageously be formed of a non-corrosive, electrically conductive material throughout, such as a cadmium plated galvanized steel. In this manner, the contact section 120 is electrically conductive while minimizing or precluding oxidation, and sufficient strength may be readily imparted to retainer 115 to withstand the use and abuse to which doors of this type are commonly subjected. Alternatively, the retainer 115 could be of other metallic or plastic materials, with the contact section 120 being of a conductive material or at least coated on the outer surface opposite door 111 with a conductive coating.

For purposes of securing the retainer 115 to door 111, the retainer 115 has a U-shaped intermediate leg 125 which may be an extension of the return flange 121. The intermediate leg 125 may supportingly underlie the receivers 116, 117 and engage a substantial portion of the width of the bottom 113 of door 111. If desired, the intermediate leg 125 may have a perpendicular leg 126 which engages the inner face 114 of the door 111 for enhanced stability.

The exemplary second embodiment of the invention depicted in FIGS. 4 and 5 of the drawings shows a rectangular segment of a door, generally indicated by the numeral 311. The door 311, as shown for exemplary purposes, has a generally rectangular cross section which includes an outer face 312, a bottom 313, and an inner face 314. In this instance, the door 311 is a typical one-piece door which is pivoted medially thereof and moves downwardly and inwardly into a door opening.

The astragal, generally indicated by the numeral 310, has a retainer, generally indicated by the numeral 315, with a pair of spaced receivers 316 and 317, which inwardly thereof form a pair of substantially parallel spaced grooves 318 and 319, respectively. As shown, the grooves 318, 319 are substantially cylindrical; however, it will be appreciated that oblong circular configurations, triangles, or other geometric configurations could be successfully employed. The receivers 316, 317 of the retainer 315 are spaced and joined by a contact section 320, which may advantageously be positioned substantially tangential to the grooves 318 and 319 formed by the receivers 316 and 317. The receivers 316 and 317 may be formed by configured flange areas 320' and 320" of contact section 320 and cooperatively formed retaining clips 321 and 322. The contact section 320 and the retaining clips 321 and 322 are spaced a distance to form openings 323 and 324.

The retainer 315 may advantageously be formed of a non-corrosive, electrically conductive material throughout, such as a cadmium plated galvanized steel. In this manner, the contact section 320 is in part electrically conductive, while minimizing or precluding oxidation, and sufficient strength may be readily imparted to retainer 315 as with respect to retainer 15. Alternatively, the retainer 315 could be of other metallic or plastic materials, with the contact section 320 being of a conductive material, or at least coated on the outer surface opposite door 311 with a conductive coating, and the flange areas 320', 320" and retaining clips 321, 322 being of a different material.

For purposes of securing the retainer 315 to door 311, the contact section flange areas 320' and 320" may be provided with longitudinally spaced bores 325 through which appropriate fasteners 326 may be inserted into the door 311 to attach the contact section 320 and retaining clips 321, 322 thereto. The retainer 315 is thus positioned at the corner of the door between the bottom 313 and the inner face 314. It will be appreciated by persons skilled in the art that suitable fasteners may be selected depending upon the material from which door 311 is constructed.

The astragal 310 has a sealing member, generally indicated by the numeral 330, in FIGS. 4 and 5 of the drawings. The sealing member 330 has an elongate tubular body 331 which extends the width of the door 311 and which is of a generally circular cross section. The tubular body 331 may be provided with a plurality of radially outwardly projecting nubs 332 which, like nubs 32, extend longitudinally of tubular body 331, preferably the entire longitudinal extent thereof. The nubs 332 may be radially outwardly tapered to an apex for purposes of effecting essentially point contact with an apron, the ground, or other surface to which a seal is to be effected relative to the door 311 when it is in the closed position. To insure contact with irregular surfaces or in the event portions of the tubular body 331 are substantially deflected, a plurality of nubs 332 may be positioned circumferentially spaced on the side portions of sealing member 330 in the mounted position on a door 311 due to the angular approach of a pivotally closing door.

Referring to FIG. 5, the tubular body 331 is outwardly discontinuous at a pair of circumferential ends, generally indicated by the numerals 335 and 336. The circumferential ends 335, 336 include enlarged projections 337 and 338, respectively. As can best be seen in FIG. 4, the projections 337 and 338 are spaced and positioned such as to interfit with the grooves 318 and 319, respectively, of the retainer 315 without significant deflection from the initial configuration depicted in FIG. 5 of the drawings. As shown, the projections 337, 338 are substantially cylindrical and sized to fit the grooves 318, 319. If desired, a portion of the projections 337, 338 may be removed to form flats 339 and 340. The flats 339, 340 are provided to facilitate the sliding ingress and egress of projections 337, 338 in the grooves 318, 319 if it is desired to insert a sealing member 330 in retainer 315 without removing fasteners 326 and retaining clips 321 and 322.

The circumferential ends 335, 336 of sealing member 330 have marginal lands 341 and 342 which, in part, interconnect the tubular body 331 with the enlarged projections 337, 338, respectively. The lands 341 and 342 are also interconnected by a carrier 345 which is of arcuate configuration. As shown, the carrier 345 and lands 341, 342 are substantially in a U-shaped configuration centered generally centrally of the contact section 320 of retainer 315 when the astragal 310 is in the assembled position depicted in FIG. 4 of the drawings. The radial inner surface of the carrier 345 mounts substantially medially thereof a conductive strip 346 which is in unobstructed facing relationship to the contact section 320 of the retainer 315 when the astragal 310 is in the mounted configuration depicted in FIG. 4 of the drawings. The conductive strip 346 is of a sufficient arcuate extent such that when the sealing member 330 engages an object so that the body portion 331 is deflected into the carrier 345, which is in turn displaced toward the contact section 320 of retainer 315, there will necessarily be a sufficient contact area as between conductive strip 346 and contact section 320 to provide the requisite indicia to operate as a switch for the control system for the door 311. As best seen in FIG. 4, the openings 323, 324 to the grooves 318, 319 are preferably somewhat wider than the proximate portions of the lands 341, 342 such that the enlarged projections 337, 338 may rotate to a limited extent in the grooves 318, 319 to permit the requisite displacement of the carrier 345 without undue deflection of the lands 341, 342 in the areas proximate to the projections 337, 338. The materials and formation of tubular body 331 and conductive strip 346 may be the same as body 31 and conductive strip 46.

Figure 6:
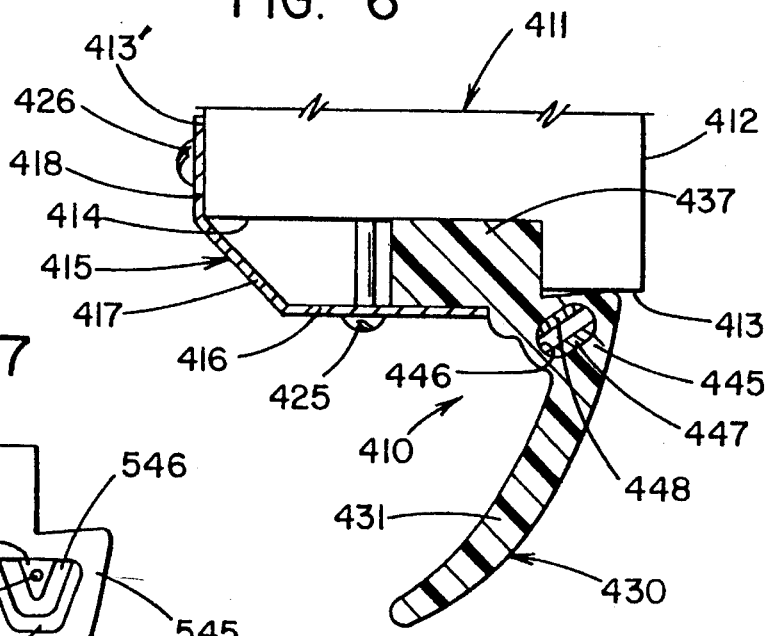
FIG. 6 is a cross-sectional view of an exemplary astragal showing a third embodiment of the concepts of the present invention, having an arcuate sealing element, a resilient carrier, and a pair of electrically conductive strip elements mounted within the resilient carrier, the view depicting the astragal shown mounted on the bottom of a vertically moving door.

In the exemplary third embodiment of the invention depicted in FIG. 6 of the drawings, there is shown a rectangular segment of a door, generally indicated by the numeral 411. The door 411, as shown for exemplary purposes, has a generally rectangular cross section which includes an outer face 412, a bottom 413, and an inner face 413'. In this instance, the door 411 could be a typical sectional door wherein the sections are hinged together, and the portion shown in FIG. 6 is the lowermost section. As shown, the door bottom 413 has a rectangular cutout 414, which is adapted to receive an astragal, generally indicated by the numeral 410. It is to be appreciated that the cutout 414 may take other geometric configurations and may be otherwise positioned relative to the lateral dimension of the door bottom 413.

As shown in FIG. 6 of the drawings, the cutout 4 14 is encompassed in substantial part by a retainer, generally indicated by the numeral 415. The retainer 415 has a horizontal leg 416 which underlies a substantial portion of the lateral dimension of the cutout 414, an intermediate leg 417, and an upright leg 418, which engages the inner face 413' of the door 411 for enhanced stability. The retainer 415, in this instance, may be formed of any metallic or plastic material of suitable strength whether electrically conductive or not. For purposes of securing the retainer 415 to door 411, the horizontal leg 416 and the upright leg 418 may be provided with longitudinally-spaced bores (not shown) through which appropriate fasteners 425 and 426 may be inserted to extend into the door 411. It will be appreciated by persons skilled in the art that suitable fasteners may be selected depending upon the material from which door 411 is constructed.

The astragal 410 has a sealing member, generally indicated by the numeral 430 in FIG. 6 of the drawings. The sealing member 430 has an elongate arcuate body 431 which normally extends the width of the door 411 and which is of a generally curved configuration extending downwardly and rearwardly of the door 411. The arcuate body 431 may be provided with a decreasingly tapering cross-sectional thickness progressing away from the retainer which is sufficient to maintain the shape depicted in FIG. 6 but permits upward deflection to effect a sealing function when even a somewhat irregular surface is engaged during closing of door 411. The curved configuration and thickness of arcuate body 431 are selected to insure a deflection toward and rearwardly of the door 411 in all instances.

The sealing member 430 has at the extremity opposite arcuate body 431 an enlarged projection 437. As shown, the enlarged projection 437 is of a generally rectangular configuration which interfits in the rectangular cutout 414 in door 411 and is secured therein by the retainer 415. In particular, the horizontal leg 416 of retainer 415 underlies the projection 437 and seats it in the cutout 414.

Interposed between the arcuate body 431 and enlarged projection 437 is a carrier 445. The carrier 445 has a central opening 446 which, as shown, is configured in cross-section like an oblate sphere. The polar regions of the opening 446 mount a pair of conductive strips 447 and 448 in unobstructed spaced facing relation to each other. In the arrangement shown in FIG. 6, the conductive strips 447, 448 are in substantially parallel alignment, with the opening 446 positioned and oriented such that both upward displacement and pivotal movement of arcuate body 431 tend to reduce the distance between the conductive strips 447, 448. The conductive strips 447 and 448 are shown in their normal position in FIG. 6. When sealing member 430 engages an object and is deflected upwardly and pivotally toward door 411, the conductive strips 447, 448 are temporarily brought into contact over a sufficient area to provide the requisite indicia to operate as a switch for a control system for the door 411.

Exemplary materials which might be employed for constructing the sealing member 430 are foamable, extrudable, relatively flexible thermoplastics such as chlorinated polyethylene, ethylene propylene diamine, polyvinyl chloride, or alpha butyl styrene. The conductive strips 447, 448 of sealing member 430 may be of dense conductive EPDM or dense conductive silicone elastomer. The judicious selection of these materials can make possible the simultaneous coextrusion of the arcuate body 431 and the conductive strips 447, 448 such as to provide an integral sealing member 430.

Figure 7:
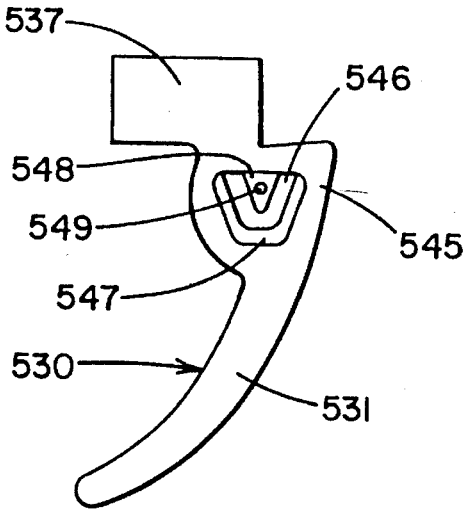
FIG. 7 is a cross-sectional view showing a modified form of the electrically conductive strips of FIG. 6.

A modified form of sealing member, generally indicated by the numeral 530 in FIG. 7 of the drawings, is shown for use in conjunction with a door 411 and the retainer 415 of FIG. 7 of the drawings. Sealing member 530 has an arcuate body 531 and an enlarged projection 537 which may be essentially identical to the arcuate body 431 and the enlarged projection 437 shown in FIG. 6.

The sealing member 530 differs from the sealing member 430 in the area of the carrier 545. In particular, the carrier 545 has a central opening 546 which, as shown, is of a generally trapezoidal configuration in cross section. The opening 546 mounts a pair of conductive strips 547 and 548 in unobstructed spaced facing relation to each other. The conductive strip 547 is of a generally U-shaped configuration in conforming to the two nonparallel sides of the trapezoid and one of the parallel sides. The conductive strip 548 is of a triangular configuration which extends from the other of parallel sides of the trapezoid into a location substantially medially of the U-shaped configuration of conductive strip 547.

When the sealing member 530 engages an object and is deflected upwardly and pivotally toward a door 411 on which it is mounted, the conductive strips 547, 548 are temporarily brought into contact over a sufficient area to provide the requisite indicia to operate as a switch for the control system for door 411. The configuration and relationship of the conductive strips 547, 548 is such as to assure that contact of the sealing member 530 from any direction will result in switch actuation. The same material considerations are applicable as were discussed in conjunction with the sealing member 430 of the third embodiment of the invention. If desired to alter the resistance characteristics of the conductive strip 548, a wire 549 of a conductive material such as copper may be embedded within the triangular configuration, as seen in FIG. 7.

Figure 8:
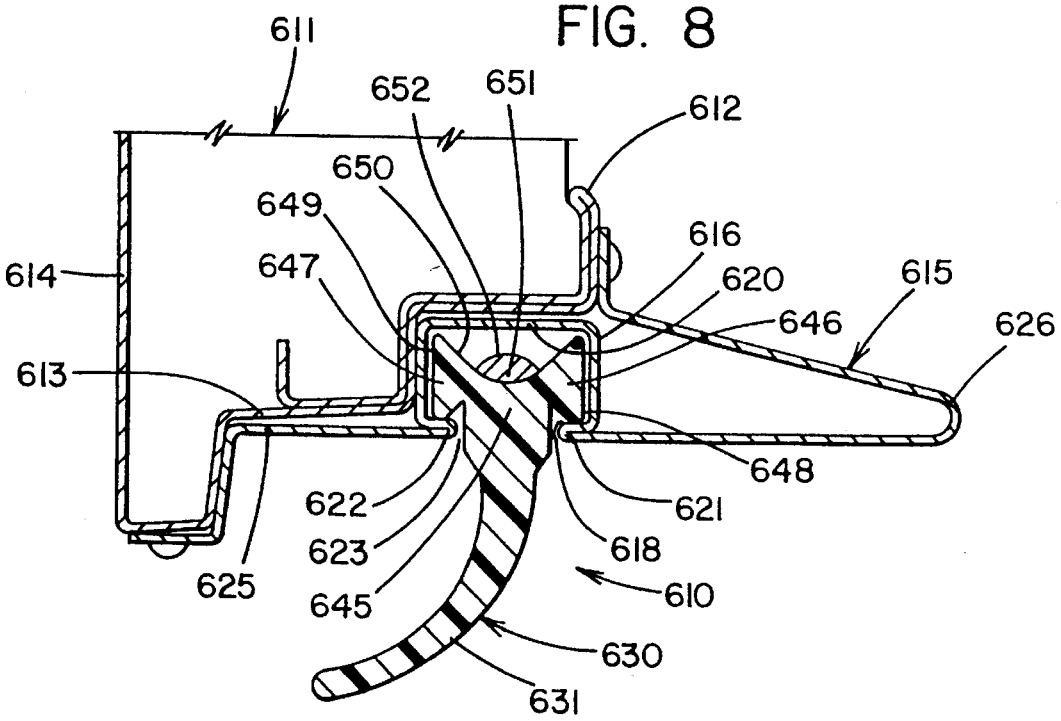
FIG. 8 is a cross-sectional view of an exemplary astragal showing a fourth embodiment of the concepts of the present invention having an arcuate sealing element, a resilient carrier, and an electrically conductive strip element of the astragal.

The exemplary fourth embodiment of the invention depicted in FIG. 8 of the drawings shows a segment of a door, generally indicated by the numeral 611. The door 611, as shown for exemplary purposes, has a generally rectangular cross section which includes an outer face 612, a stepped bottom 613, and an inner face 614. The door 611 is a typical sectional door of the type described in conjunction with the first embodiment of the invention.

The astragal, generally indicated by the numeral 630, has a retainer, generally indicated by the numeral 615, with a receiver 616, which inwardly thereof forms a groove 618. As shown, the groove 618 is substantially rectangular; however, it will be appreciated that an oblong circular configuration, triangle, or other geometric configuration could be successfully employed. The receiver 616 of the retainer 615 includes a contact section 620, which is positioned in the groove 618 formed by the receiver 616. The receiver 616 may be formed by reverse flange areas 621 and 622 which are spaced a distance to form an opening 623.

The retainer 615 may advantageously be formed of a non-corrosive, electrically conductive material throughout, such as a cadmium plated galvanized steel. In this manner, the contact section 620 is electrically conductive, while minimizing or precluding oxidation, and sufficient strength may be readily imparted to retainer 615 as with respect to retainer 15. Alternatively, the retainer 615 could be of other metallic or plastic materials, with the contact section 620 being of a conductive material or at least coated on the outer surface with a conductive coating.

For purposes of securing the retainer 615 to door 611, the reverse flange area 622 may have an extension 625 configured to conform to the stepped bottom 613 of the door 611. As shown, the reverse flange area 621 has a hairpin support extension 626 which engages the outer face 612 of the door 611 for enhanced stability of the mounted retainer 615. The retainer 615 may be secured to the door 611 by employing suitable conventional fasteners (not shown) of the type shown and described in relation to the above-disclosed embodiments of the invention.

The astragal 610 has a sealing member, generally indicated by the numeral 630 in FIG. 8 of the drawings. The sealing member 630 has an elongate arcuate body 631 which extends the width of the door 611 and which is of a generally curved configuration extending downwardly and rearwardly of the door 611. The arcuate body 631 may be configured and operate in the manner of arcuate bodies 431 and 531 described hereinabove.

The sealing member 630 has at the extremity opposite arcuate body 631 an enlarged carrier 645. The carrier is adapted to interfit within the groove 618 in receiver 616 of retainer 615. The carrier 645 has enlarged laterally extending projections 646 and 647 which, as shown, are somewhat triangularly configured with each having a base surface 648 and 649, respectively, which interfit and engage the lateral extremities of the rectangular groove 618.

Positioned between the laterally extending projections 646, 647 on carrier 645 is a radially inwardly curved surface 650 positioned opposite the arcuate body 631. The surface 650 mounts preferably substantially medially thereof a conductive strip 651 which is in unobstructed facing relationship to the contact section 620 of retainer 615. As shown, the conductive strip 651 is of a sufficient arcuate extent and may have a somewhat convex outer surface 652. Thus, when the sealing member 630 engages an object so that the arcuate body 631 deflects the carrier 645 toward the contact section 620 of retainer 615, there will necessarily be a sufficient contact area as between conductive strip 651 and contact section 620 to provide the requisite indicia to operate as a switch for a control system for the door 611. The materials and formation of arcuate body 631, carrier 645, and conductive strip 65 1 may be the same as body 31, carrier 45, and conductive strip 46.

Figure 12:
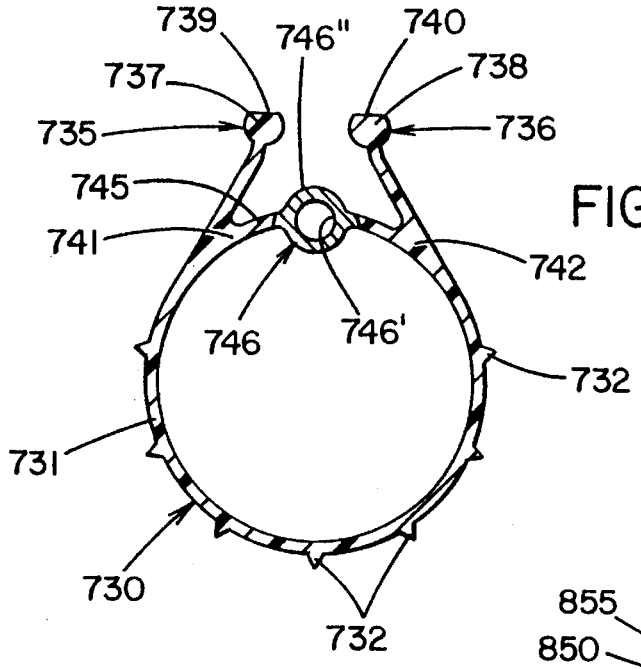
FIG. 12 is a cross-sectional view showing a fifth embodiment of the concepts of the present invention having a tubular sealing element and a resilient carrier incorporating an annular conductive element, as adapted for use in conjunction with retainer elements of the type depicted in FIGS. 1 and 2.

A modified form of sealing member, generally indicated by the numeral 730 in FIG. 12 of the drawings, is shown in a form adapted for use in conjunction with retainers 15, 115 employed on doors 11, 111, as seen in FIGS. 1 and 2. It will be appreciated that with suitable modification, sealing member 730 could be employed in conjunction with retainer 315 or other configuration.

The sealing member 730 has an elongate tubular body 731 which preferably extends the width of a door and which is of a generally circular cross section. The tubular body 731 may be provided with a plurality of radially outwardly projecting nubs 732 which, like nubs 32 and 332, extend longitudinally of tubular body 731 preferably the entire longitudinal extent thereof. The nubs 732 may be radially outwardly tapered to an apex for purposes of effecting essentially point contact with an apron, the ground, or other surface to which a seal is to be effected relative to a door when it is in the closed position. To insure contact with irregular surfaces or in the event portions of the tubular body 731 are substantially deflected, a plurality of hubs 732 may be positioned circumferentially spaced on the side portions of sealing member 730 in the mounted position on a door due, for example, to the angular approach of a pivotally closing door.

The tubular body 731 is outwardly discontinuous at a pair of circumferential ends, generally indicated by the numerals 735 and 736. The circumferential ends 735, 736 include enlarged projections 737 and 738, respectively. As can be seen, the projections 737 and 738 are spaced and positioned such as to interfit with the grooves 18 and 19, respectively, of the retainer 15 without significant deflection from the configuration depicted in FIG. 12. As shown, the projections 737, 738 are substantially cylindrical and sized to fit the grooves 18, 19. If desired, a portion of the projections 737, 738 may be removed to form flats 739 and 740. The flats 739, 740 are provided to facilitate the sliding ingress and egress of projections 737, 738 in the grooves 18, 19 if it is desired to insert a sealing member 730 in retainer 15 from one end of a door.

The circumferential ends 735, 736 of sealing member 730 have marginal lands 741 and 742 which, in part, interconnect the tubular body 731 with the enlarged projections 737, 738, respectively. The lands 741 and 742 are also interconnected by a carrier 745 which is of arcuate configuration. As shown, the carrier 745, lands 741, 742, and tubular body 731 are of a substantially circular configuration in cross section, centered generally centrally of tubular body 731 when the sealing member 730 is in the assembled position. The radial inner surface of the carrier 745 mounts substantially medially thereof a conductive strip 746 which is in unobstructed facing relationship to the contact section of a retainer when the sealing member 730 is in a mounted configuration. The conductive strip 746 is of a sufficient arcuate extent such that when the sealing member 730 engages an object, so that the tubular body 731 is deflected into the carrier 745, which is in turn displaced toward the contact section 20 of the retainer 15, there will necessarily be a sufficient contact area as between conductive strip 746 and contact section of a retainer to provide the requisite indicia to operate as a switch for the control system for the door as described hereinafter. The projections 737, 738 may be sized to rotate to a limited extent in the grooves of a retainer to permit the requisite displacement of the carrier 745 without undue deflection of the lands 741, 742 in the areas proximate to the projections 737, 738, as discussed in conjunction with the first embodiment of the invention. The materials and formation of tubular body 731 and conductive strip 746 may be the same as body 31 and conductive strip 46.

The conductive strip 746 shown in FIG. 12 preferably located substantially medially of the carrier 745 is of an annular configuration and preferably of substantially circular cross-section to provide structural rigidity and uniform deflection. It will be appreciated that the cross-section could be somewhat oblate in order to adjust the contact surface with a retainer during deflection or for other purposes. A substantially circular cross-section is also highly advantageous for purposes of achieving optimum electrical and mechanical connection of conductive strip 746 with the hereinafter described wiring systems by use of conventional male electrical connectors sized to the inside diameter 746' of strip 746.

The strip 746 has an outside diameter 746" which is sized to provide the requisite surface contact with a retainer and satisfy other considerations. In this respect, it has been observed that the material thickness of the annular conductive strip of conductive elastomeric polymers of the type hereinabove enumerated is advantageously in the range of 0.03 inch to 0.1 inch and preferably approximately 0.045 inch to provide appropriate actuation sensitivity. Erratic electrical resistance and undue creep or sag may be encountered with material of a lesser thickness than this range. The conductive strip 746 may extend radially outwardly of the annular area from substantially diametrically disposed locations a distance sufficient to provide optimum coextrusion or dual extrusion characteristics and to provide a cross-sectional area having the requisite resistance characteristics.

Figure 13:
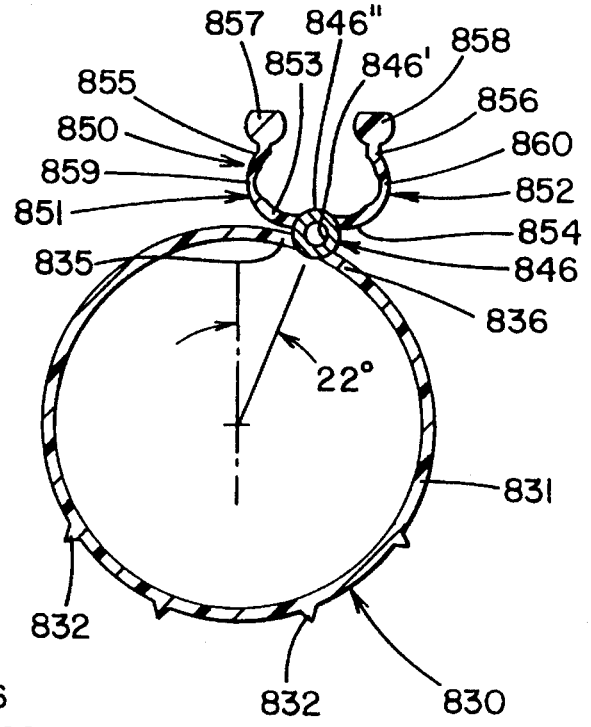
FIG. 13 is a cross-sectional view showing a sixth embodiment of the concepts of the present invention having a tubular sealing element attached to an annular electrically conductive strip to which a resilient carrier is also attached which has ends adapted for use with retainer elements of the type depicted in FIGS. 1 and 2.

A modified form of sealing member, generally indicated by the numeral 830 in FIG. 13 of the drawings, is shown in a form adapted for use in conjunction with retainers 15, 115 employed on doors 11, 111, as seen in FIGS. 1 and 2. It will be appreciated that with suitable modification, sealing member 830 could be employed in conjunction with retainer 315 or other configurations.

The sealing member 830 has an elongate tubular body 831 which preferably extends the width of a door and which is of a generally circular cross section. The tubular body 831 may be provided with a plurality of radially outwardly projecting nubs 832 which, like nubs 32 and 332, extend longitudinally of tubular body 831, preferably the entire longitudinal extent thereof. The nubs 832 may be configured and positioned observing the parameters discussed particularly in conjunction with nubs 32 and 332.

The tubular body 831 is discontinuous at a pair of circumferential ends, generally indicated by the numerals 835 and 836. The ends 835, 836 are affixed to a conductive strip 846 which is in unobstructed facing relationship to the contact section of a retainer when the sealing member 830 is in a mounted configuration. The conductive strip 846 is of a sufficient arcuate extent such that when the sealing member 830 engages an object, so that the tubular body 831 is deflected into the conductive strip 846, which is in turn displaced toward the contact section of retainer 15, 115, there will necessarily be a sufficient contact area as between conductive strip 846 and contact section of a retainer to provide the requisite indicia to operate as a switch for the control system for the door as described hereinafter.

The conductive strip 846 shown in FIG. 13 is of an annular configuration and preferably of substantially circular cross-section to provide structural rigidity and uniform deflection. It will be appreciated that the cross-section could be somewhat oblate in order to adjust the contact surface with a retainer during deflection or for other purposes. A substantially circular cross-section is also highly advantageous for purposes of achieving optimum electrical and mechanical connection of conductive strip 846 with the hereinafter described wiring systems by use of conventional male electrical connectors sized to the inside diameter 846' of strip 846.

The ends 835 and 836 of tubular body 831 are attached to the conductive strip 846 preferably at slightly less than diametrically opposed locations on the surface thereof, as seen in FIG. 13. The strip 846 has an outside diameter 846" which is sized to provide an optimum contact area and material thickness pursuant the considerations discussed in conjunction with conductive strip 746 of FIG. 12 of the drawings.

Also attached to the conductive strip 846 is a resilient carrier, generally indicated by the numeral 850. As shown, the carrier 850 includes a pair of curved legs 851 and 852 having connector ends 853 and 854, respectively, which are attached to the conductive strip 846 preferably at slightly less than diametrically opposed locations on the surface thereof, as seen in FIG. 13. While the end 835, tubular body 831, and connector end 853 of carrier 850 are shown attached to conductive strip 846 at slightly circumferentially spaced locations, such could be contiguous. The end 836 and connector end 854 are shown similarly attached in FIG. 13. The attachment of ends 835 and 853 at one side of conductive strip 846 and the attachment of ends 836 and 854 at the other side thereof are normally substantially identical for uniformly balanced operation, independent of the location and angular positioning of an obstructing object. The extent of attachment location variations extends at an opposite extreme to a tangential engagement by tubular body 831 and carrier 850 with ends 835 and 836 and connector ends 853 and 854 in mutual axial alignment and in engagement or close proximity thereto.

The curved legs 85 1 and 852 have, at the extremities opposite the connector ends 853, 854, a pair of securement ends, generally indicated by the numerals 855 and 856. The securement ends 855, 856 include enlarged projections 857 and 858, respectively. As can be seen, the projections 857 and 858 are spaced and positioned such as to interfit with the grooves 18 and 19, respectively, of the retainer 15 without significant deflection from the configuration depicted in FIG. 13. As shown, the projections 857, 858 are similarly sized and configured to carry out the aforedescribed functions of the projections 37, 38.

The curved legs 851, 852 and conductive strip 846 form a generally U-shaped configuration which can readily be designed to collapse or distort to displace conductive strip 846 into contact with a retainer upon the application of a preselected force on the tubular body 831. The material constitution of legs 851, 852 and the thickness thereof are primary factors in these design considerations. In addition, the legs 851, 852 may have intermediate sections 859 and 860 which are of reduced thickness to facilitate bending thereat, thus allowing enhanced actuation sensitivity by response to reduced forces.

It is also significant to note that sealing member 830, in having the conductive strip 846 interposed between tubular body 831 and the carrier 850, effectively decouples or removes interaction between these members. Thus, forces applied to effect sealing operate primarily on the tubular body 831, and forces effecting electrical actuation operate primarily on the carrier 850. The operation of the carrier 850 may be, significantly, virtually independent of and unaffected by the distortion of the tubular body 831. As a result, greater actuation sensitivity may be provided for forces applied to tubular body 831 from below in substantially the plane of the door. Further, ultrasensitivity to side or lateral forces may be controlled or eliminated more readily with the arrangement of this embodiment.

Although sealing member 830 could have the tubular body 831 centered below the vertical centerline of the carrier 830, it may be advantageous to provide an angular offset in certain circumstances. As shown in FIG. 13, the tubular body is offset at an angle of approximately 22°. The offset is provided to displace sealing member 830 rearwardly with respect to the plane of the outer face 12, 112 of a door 11, 111 which would be proximate leg 852 with sealing member 830 mounted on the doors depicted in FIGS. 1 and 2. The angular offset may be employed to eliminate interference or provide additional clearance between sealing member 830 and a door jamb and is normally critical in the area at the upper edge of the jamb where the roller track positioning the lower extremity of the door transcends between vertical and horizontal sections. As will be appreciated by persons skilled in the art, the existence and extent of an angular offset will depend on door thickness, diameter of sealing member 830, jamb structure and location, door roller size and location, and numerous other factors.

Figure 14:
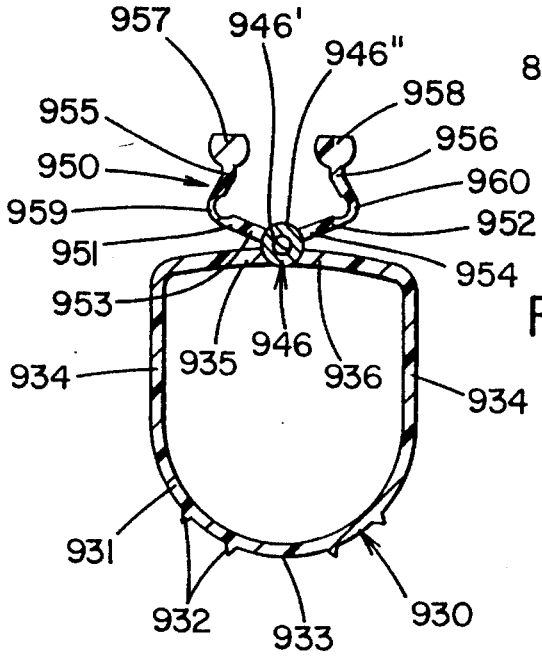
FIG. 14 is a cross-sectional view showing a seventh embodiment of the concepts of the present invention having a U-shaped sealing element attached to an annular electrically conductive strip to which a resilient carrier is also attached which has ends adapted for use with retainer elements of the type depicted in FIGS. 1 and 2.

Another modified form of sealing member, generally indicated by the numeral 930 in FIG. 14 of the drawings, is shown in a form adapted for use in conjunction with retainers 15, 115 employed on doors 11, 111, as seen in FIGS. 1 and 2. It will be appreciated that with suitable modification, sealing member 930 could be employed in conjunction with retainer 315 or other configurations.

The sealing member 930 has an elongate somewhat tubular body 931 which preferably extends the width of a door and which is of a generally U-shaped cross section, including a semicircular bottom 933 and a pair of parallel sides 934 and 934. The parallel sides 934, 934 may be of a length sufficient to position semicircular bottom 933 a desired distance below a retainer 15, 115. With this configuration, desired operational parameters can be met with a bottom 933 having a lesser radius than the radius of the tubular body 831. Such a size reduction may be employed to eliminate interference with a door jamb, as discussed in conjunction with tubular body 831. The tubular body 931 may be provided with a plurality of radially outwardly projecting nubs 932 which, like nubs 32 and 332, extend longitudinally of tubular body 931, preferably the entire longitudinal extent thereof. The nubs 932 may be configured and positioned on bottom 933 and sides 934, 934 observing the parameters discussed particularly in conjunction with nubs 32 and 332.

The tubular body 931 is discontinuous at a pair of laterally inturned ends, generally indicated by the numerals 935 and 936. The ends 935, 936 are affixed to a conductive strip 946 which is in unobstructed facing relationship to the contact section of a retainer when the sealing member 930 is in a mounted configuration. The conductive strip 946 is of a sufficient arcuate extent such that when the sealing member 930 engages an object, so that the tubular body 931 is deflected into the conductive strip 946, which is in turn displaced toward the contact section of retainer 15, 115, there will necessarily be a sufficient contact area as between conductive strip 946 and contact section of a retainer to provide the requisite indicia to operate as a switch for the control system for the door as described hereinafter.

The conductive strip 946 shown in FIG. 14 is of an annular configuration and preferably of substantially circular cross-section to provide structural rigidity and uniform deflection. It will be appreciated that the cross-section could be somewhat oblate in order to adjust the contact surface with a retainer during deflection or for other purposes. A substantially circular cross-section is also highly advantageous for purposes of achieving optimum electrical and mechanical connection of conductive strip 946 with the hereinafter described wiring systems by use of conventional male electrical connectors sized to the inside diameter 946' of strip 946.

The ends 935 and 936 of tubular body 931 are attached to the conductive strip 946 preferably at slightly less than diametrically opposed locations on the surface thereof, as seen in FIG. 14. The strip 946 has an outside diameter 946" which is sized to provide an optimum contact area and material thickness pursuant the considerations discussed in conjunction with conductive strip 746 of FIG. 12 of the drawings.

Also attached to the conductive strip 946 is a resilient carrier, generally indicated by the numeral 950. As shown, the carrier 950 includes a pair of angled legs 951 and 952 having connector ends 953 and 954, respectively, which are attached to the conductive strip 946 preferably at slightly less than diametrically opposed locations on the surface thereof, as seen in FIG. 14. While the end 935, tubular body 931, and connector end 953 of carrier 950 are shown attached to conductive strip 946 at slightly circumferentially spaced locations, such could be contiguous. The end 936 and connector end 954 are shown similarly attached in FIG. 14. The attachment of ends 935 and 953 at one side of conductive strip 946 and the attachment of ends 936 and 954 at the other side thereof are normally substantially identical for uniformly balanced operation, independent of the location and angular positioning of an obstructing object. The extent of attachment location variations extends at an opposite extreme to a tangential engagement by tubular body 931 and carrier 950 with ends 935 and 936 and connector ends 953 and 954 in mutual axial alignment and in engagement or close proximity thereto.

The angled legs 951 and 952 have, at the extremities opposite the connector ends 953, 954, a pair of securement ends, generally indicated by the numerals 955 and 956. The securement ends 955, 956 include enlarged projections 957 and 958, respectively. As can be seen, the projections 957 and 958 are spaced and positioned such as to interfit with the grooves 18 and 19, respectively, of the retainer 15 without significant deflection from the configuration depicted in FIG. 14. As shown, the projections 957, 958 are similarly sized and configured to carry out the aforedescribed functions of the projections 37, 38.

The angled legs 951, 952 and conductive strip 946 form a generally U-shaped configuration which can readily be designed to collapse or distort to displace conductive strip 946 into contact with a retainer upon the application of a preselected force on the tubular body 931. The material constitution of legs 951, 952 and the thickness thereof are primary factors in these design considerations. In addition, the legs 951, 952 may have intermediate sections 959 and 960 which are of reduced thickness to facilitate bending thereat, thus allowing enhanced actuation sensitivity by response to reduced forces. The angulation of legs 951, 952 may be concentrated in intermediate sections 959, 960 where a severe angular reorientation takes place over a relatively short radius of a fraction of an inch. As shown in FIG. 14, the angular reorientation is approximately 80°; however, this may be appropriately varied to achieve a desired sensitivity based upon factors such as the material and the thickness of legs 951, 952, material thickness in the intermediate sections 959, 960, particular configuration of the retainer 15, and similar factors which will be apparent to persons skilled in the art.

It is also significant to note that sealing member 930, in having the conductive strip 946 interposed between tubular body 931 and the carrier 950, effectively decouples or removes interaction between these members. Thus, forces applied to effect sealing operate primarily on the tubular body 931, and forces effecting electrical actuation operate primarily on the carrier 950. The operation of the carrier 950 may be, significantly, virtually independent of and unaffected by the distortion of the tubular body 931. As a result, greater actuation sensitivity may be provided for forces applied to tubular body 931 from below in substantially the plane of the door. Further, ultrasensitivity to side or lateral forces may be controlled or eliminated more readily with the arrangement of this embodiment.

Figure 9:
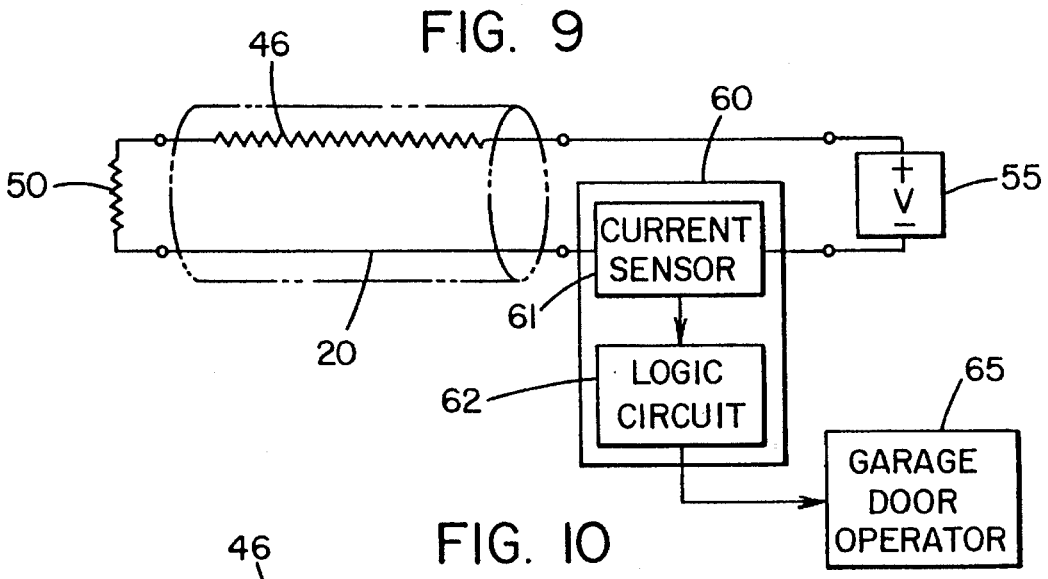
FIG. 9 is a partial electrical schematic and block diagram of an exemplary circuit embodying the concepts of the present invention showing a two-wire electrical connection to the control circuit and power supply at one end of the contact section and the electrically conductive strip element.
Figure 10:
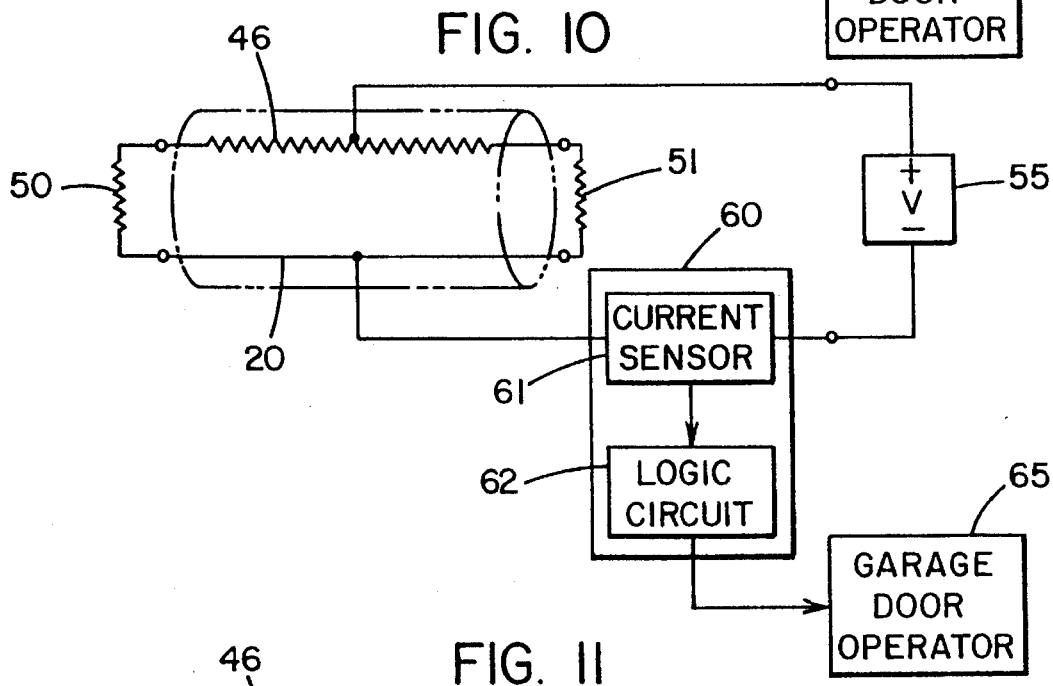
FIG. 10 is a partial electrical schematic and block diagram of another exemplary circuit showing a two-wire electrical connection to the control circuit and .power supply at the center of the contact section and the center of the electrically conductive strip element.
Figure 11:
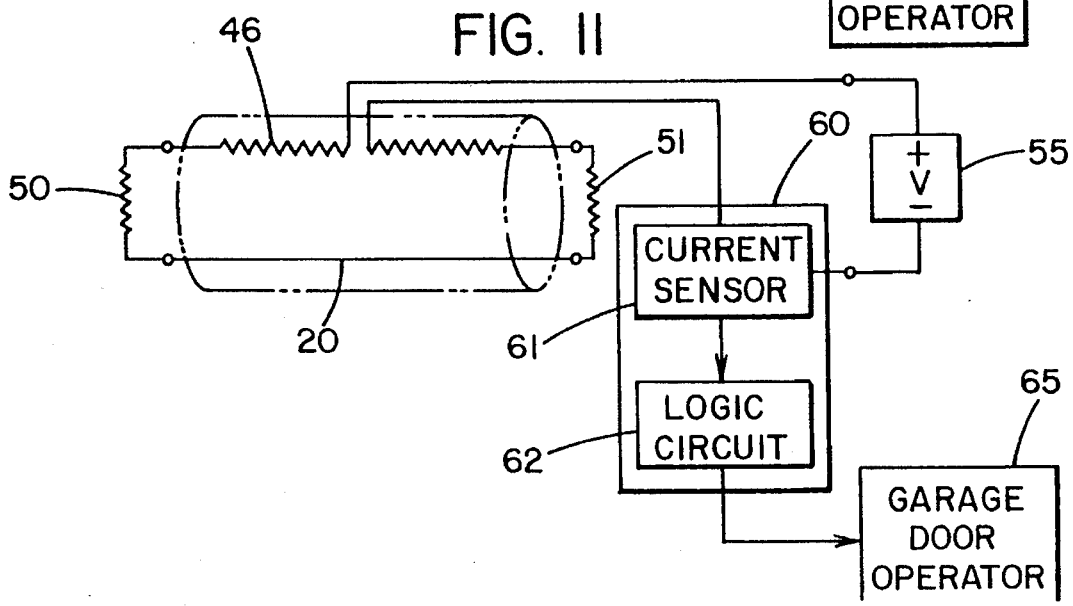
FIG. 11 is a partial electrical schematic and block diagram of yet another exemplary circuit showing a split in the electrically conductive strip element and electrical connection and a two-wire electrical connection to the control circuit and the power supply at the split ends of the electrically conductive strip element.

FIGS. 9, 10 and 11 present partial schematics and block diagrams of three exemplary, fail-safe, two-wire electrical wiring configurations in accordance with the present invention. While these figures illustrate electrical connection to contact section 20 and conductive strip 46 of the first embodiment discussed hereinabove, these wiring configurations are equally suitable for utilization with the contact section 120 and conductive strip 46 of the modified retainer 115 and the contact section 320 and conductive strip 346 of the second embodiment discussed hereinabove.

The three exemplary two-wire electrical wiring configurations of FIGS. 9, 10 and 11 all employ at least end resistors 50, 51, and are electrically connected to a power supply 55 and a control circuit 60. End resistors 50, 51, which electrically connect an end of connect section 20 and conductive strip 46, may be discrete component resistors or resistive materials of the desired resistances as explained further hereinbelow integrally formed in an end cap (not shown). Power supply 55 may be of any suitable voltage such as 5 Volts commonly used today in many applications or 24 Volts commonly used in garage doors and other applications installed in prior years. Control circuit 60 may include a current sensor 61 for monitoring the current in conductive strip 46 in the selected two-wire circuit and generating an alarm signal whenever the current magnitude is outside preselected limits, and a logic circuit 62 receiving the alarm signal from current sensor 61 and generating a suitable control signal to a garage door operator 65 or other device responsible for discontinuing closing travel of door 11 and reversing same. Where door 11 is made of a conductive material, the circuit may be electrically connected to door 11 for grounding, thereby minimizing the introduction of electrical interference and other noise that might deleteriously effect its operation.

In the wiring configuration depicted in FIG. 9, which may be called the end wired configuration, the positive terminal of power supply 55 is electrically connected to the end of conductive strip 46 opposite that electrically connected to end resistor 50. One end of current sensor 61 is electrically connected to the end of contact section 20 opposite that electrically connected to end resistor 50. In this and the other wiring configurations the negative terminal of power supply 55 is electrically connected to the terminal of current sensor 61 opposite that connected to contact section 20.

In the wiring configuration depicted in FIG. 10, which may be called the center wired configuration, the positive terminal of power supply 55 is electrically connected to conductive strip 46 in the vicinity of its center or such other location intermediate to its ends as may be found convenient and furnish the desired electrical resistances explained hereinbelow. Where the electrical resistance of contact section 20 is substantially zero, the electrical connection between current sensor 61 and contact section 20 may be made at any convenient physical location. Generally it is likely most convenient, economical and electrically preferable to make this electrical connection proximate to the lateral point of connection of the positive terminal of power supply 55 to conductive strip 46 and part of the same connector assembly (not shown).

In the wiring configuration depicted in FIG. 11, which may be called the split center wired configuration, conductive strip 46 is electrically separated at a lateral point breaking the same into two resistance segments of desired resistance. Generally it is likely most convenient, economical and electrically preferable to make this electrical connection proximate to the center lateral point of conductive strip 46. The positive terminal of power supply 55 is electrically connected to one split end of conductive strip 46, and the other split end electrically connected to one end of current sensor 61.

A simple application of Ohm's Law to the circuits depicted in FIGS. 9, 10 and 11 makes clear that operation of garage door operator 65 is controlled by the current passing therethrough, which is in turn regulated by the total resistance thereof. In the end wired configuration of FIG. 9 the maximum total resistance. is the sum of the resistance of conductive strip 46 plus the resistance of end resistor 50. The circuit of the center wired configuration of FIG. 10 presents two parallel resistances each of whose value is the sum of about one-half the resistance of conductive strip 46 and the end resistors 50, 51. In the split center wired configuration of FIG. 11 the maximum total resistance is the sum of the resistance of conductive strip 46 plus the combined resistances of end resistors 50, 51.

In the event astragal 10 or 310 strikes an obstruction sufficient to electrically engage contact section 20 and conductive strip 46, the instantaneous total resistance is changed, producing a corresponding change in current that shall be monitored by current sensor 61. The signal produced by current sensor 61 is received by logic circuit 62, compared to preselected thresholds, and if outside such thresholds, logic circuit 62 may appropriately signal garage door operator 65 to immediately cease operation or take other selected safety action.

It should be appreciated that depending on the location of electrical engagement between contact section 20 and conductive strip 46, a range of total resistances and corresponding currents may develop. Maximum resistances greater than about 50 KΩ result in pickup of too much electromagnetic noise; resistance ranges too small do not sufficiently allow for current changes resulting from component drift and aging, and temperature changes. A resistance of conductive strip 46 in the range of about 0.5 KΩ to 0.75 KΩ per foot (about 8 KΩ to 12.5 KΩ for a 16 foot wide garage door), and end resistors having values of about 10 KΩ have been found to produce an acceptable range of currents where any instantaneous resistance magnitude below about 16 KΩ represents contact by astragal 10 or 310 with an obstruction, and any magnitude above about 30 KΩ represents a malfunction in the circuit. Thus, utilizing lower resistance ranges allows the monitoring and fail-safe control of the garage door operator 65 with only a two-wire circuit.

It should be further appreciated that so long as this two-wire circuit is complete, some resistance in the preselected range will be present. Thus, by monitoring current, a determination may be made if any part of the circuit has been disconnected.

Thus it should be evident that the astragal for closing member disclosed herein carries out the various objects of the invention set forth hereinabove and otherwise constitutes an advantageous contribution to the art. As may be apparent to persons skilled in the art, modifications can be made to the preferred embodiments disclosed herein without departing from the spirit of the invention, the scope of the invention being limited solely by the scope of the attached claims.

We claim:

1. An astragal for attachment between a movable closure member and a fixed surface having a sealing device and having an electrical switching device to signal engagement with an object comprising, retainer means having an electrically conductive contact section secured to one of the closure member and the fixed surface, an elongate generally tubular sealing means for engaging the other of the closure member and the fixed surface when in close proximity, circumferential ends of said tubular sealing means selectively affixed to said retainer means at spaced locations, resilient carrier means disposed within said tubular sealing means, and electrically conductive strip means of substantially annular configuration incorporated in said carrier means in unobstructed facing relation to said contact section of said retainer means and temporarily movable into engagement with said contact section of said retainer means when an object displaces said tubular sealing means and said resilient carrier means to effect electrical contact therebetween.

2. An astragal according to claim 1, wherein said carrier means has an arcuate configuration centered substantially centrally of said tubular sealing means.

3. An astragal according to claim 1, wherein said conductive strip means is located substantially medially of said carrier means.

4. An astragal according to claim 3, wherein said conductive strip means is connected to said carrier means at substantially diametrically opposed locations.

5. An astragal according to claim 1, wherein said conductive strip means includes a portion having a circular cross-section.

6. An astragal according to claim 5, wherein said circular cross-section is a conductive elastomer having a wall thickness in the range of 0.03 inch to 0.1 inch.

7. An astragal for attachment between a movable closure member and a fixed surface having a sealing device and having an electrical switching device to signal engagement with an object comprising, retainer means having an electrically conductive contact section secured to one of the closure member and the fixed surface, an elongate generally tubular sealing means for engaging the other of the closure member and the fixed surface when in close proximity, circumferential ends of said tubular sealing means attached to electrically conductive strip means, and resilient carrier means attached to said electrically conductive strip means and having ends selectively affixed to said retainer means at spaced locations, said electrically conductive strip means being positioned in unobstructed facing relation to said contact section of said retainer means and temporarily movable into engagement with said contact section of said retainer means when an object displaces said tubular sealing means and said resilient carrier means to effect electrical contact therebetween.

8. An astragal according to claim 7, wherein said electrically conductive strip means is substantially annular.

9. An astragal according to claim 7, wherein said circumferential ends of said tubular sealing means and connector ends of said resilient carrier means are attached to said electrically conductive strip means at substantially diametrically opposed points.

10. An astragal according to claim 7, wherein said attachment points of said ends are spaced each from the other.

11. An astragal according to claim 7, wherein said resilient carrier means is generally U-shaped.

12. An astragal according to claim 7, wherein said resilient carrier means has a pair of curved legs having intermediate sections of reduced thickness relative to the remainder of said curved legs to facilitate bending thereat.

13. An astragal according to claim 12, wherein said resilient carrier means has a pair of legs with intermediate sections having a severe angular reorientation over a relatively short radius.

14. An astragal according to claim 13, wherein said intermediate sections are of reduced thickness relative to the remainder of said legs.

15. An astragal for attachment between a movable closure member and a fixed surface having a sealing device and having an electrical switching device to signal engagement with an object comprising, retainer means having an electrically conductive contact section secured to one of the closure member and the fixed surface, an elongate generally tubular sealing means for engaging the other of the closure member and the fixed surface when in close proximity, said tubular sealing means attached to electrically conductive strip means, and resilient carrier means attached to said electrically conductive strip means and having ends selectively affixed to said retainer means at spaced locations, said electrically conductive strip means being positioned in unobstructed facing relation to said contact section of said retainer means and movable substantially independent of said tubular sealing means into engagement with said contact section of said retainer means when an object displaces said tubular sealing means and said resilient carrier means to effect electrical contact therebetween.

* * * * *